US010301898B2

(12) United States Patent
Orban

(10) Patent No.: US 10,301,898 B2
(45) Date of Patent: May 28, 2019

(54) TOP DRIVE WITH TOP ENTRY AND LINE INSERTED THERETHROUGH FOR DATA GATHERING THROUGH THE DRILL STRING

(71) Applicant: Schlumberger Technology Corporation, Sugar Land, TX (US)

(72) Inventor: Jacques Orban, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 81 days.

(21) Appl. No.: 15/097,957

(22) Filed: Apr. 13, 2016

(65) Prior Publication Data

US 2016/0298441 A1 Oct. 13, 2016

Related U.S. Application Data

(60) Provisional application No. 62/146,731, filed on Apr. 13, 2015, provisional application No. 62/147,175, filed on Apr. 14, 2015, provisional application No. 62/147,205, filed on Apr. 14, 2015.

(51) Int. Cl.

| | |
|---|---|
| ***E21B 3/02*** | (2006.01) |
| ***E21B 47/12*** | (2012.01) |
| ***E21B 33/072*** | (2006.01) |

(52) U.S. Cl.

CPC ..... *E21B 33/072* (2013.01); *E21B 3/02* (2013.01); *E21B 47/122* (2013.01)

(58) Field of Classification Search

CPC ..... E21B 47/08; E21B 47/082; E21B 47/0006

See application file for complete search history.

(56) References Cited

U.S. PATENT DOCUMENTS

| | | | |
|---|---|---|---|
| 2,557,168 | A | 6/1951 | Arps et al. |
| 2,677,427 | A | 5/1954 | Mckinney |
| 2,906,342 | A | 9/1959 | Russell |
| 2,963,092 | A | 12/1960 | Anderson |
| 3,167,707 | A | 1/1965 | Oliver |
| 3,363,880 | A | 1/1968 | Blagg |
| 4,003,435 | A | 1/1977 | Cullen et al. |
| 4,090,573 | A | 5/1978 | Rankin |
| 4,126,848 | A | 11/1978 | Denison |
| 4,153,120 | A | 5/1979 | Zuvela et al. |
| 4,331,203 | A | 5/1982 | Kiefer |
| 4,578,675 | A | 3/1986 | MacLeod |
| 4,739,325 | A | 4/1988 | MacLeod |

(Continued)

FOREIGN PATENT DOCUMENTS

| | | | |
|---|---|---|---|
| CA | 2891162 | A1 | 5/2014 |
| CA | 2914552 | A1 | 12/2014 |

(Continued)

*Primary Examiner* — Nicole Coy

(74) *Attorney, Agent, or Firm* — Rachel E. Greene

(57) ABSTRACT

A method for transmitting data from a downhole instrument to a surface location includes running the downhole instrument into a wellbore on a line. The downhole instrument and at least a portion of the line are positioned inside a drill string. The downhole instrument includes first and second sets of fingers that contact an inner surface of the drill string. The downhole instrument measures an effect occurring in the drill string. The effect is due to perturbations in the drill string during a drilling process.

23 Claims, 11 Drawing Sheets

(56) References Cited

U.S. PATENT DOCUMENTS 4,857,831 A * 8/1989 Davies ..... E21B 47/00 324/357
4,965,774 A 10/1990 Ng et al.
5,107,705 A 4/1992 Wraight et al.
5,305,830 A 4/1994 Wittrisch
5,426,368 A * 6/1995 Benimeli ..... E21B 47/08 324/366
5,468,153 A 11/1995 Brown et al.
5,735,351 A 4/1998 Helms
5,881,310 A 3/1999 Airhart et al.
6,064,210 A * 5/2000 Sinclair ..... G01V 3/20 324/338
6,250,402 B1 6/2001 Brune et al.
6,341,654 B1 1/2002 Wilson et al.
6,396,276 B1 5/2002 Van Steenwyk et al.
8,044,819 B1 10/2011 Bessiere et al.
8,474,548 B1 7/2013 Young et al.
8,863,861 B2 10/2014 Zientarski
9,512,716 B2 12/2016 Liu et al.
9,638,028 B2 5/2017 Gao et al.
9,759,830 B2 * 9/2017 Andrews ..... G01V 3/08
9,765,613 B2 * 9/2017 Cramer ..... E21B 47/122
2001/0022239 A1 9/2001 Brune et al.
2002/0070030 A1 6/2002 Smith et al.
2002/0070033 A1 6/2002 Headworth
2002/0096364 A1 7/2002 Brune et al.
2003/0136583 A1 7/2003 Brune et al.
2004/0084218 A1 5/2004 Brune et al.
2005/0046588 A1 3/2005 Wisler et al.
2005/0052949 A1 3/2005 Gaston et al.
2005/0115708 A1 6/2005 Jabusch
2005/0150689 A1 * 7/2005 Jogi ..... E21B 7/06 175/45
2006/0119364 A1 6/2006 Chen et al.
2006/0124355 A1 6/2006 Brune et al.
2007/0056722 A1 3/2007 Angman et al.
2007/0181304 A1 8/2007 Rankin et al.
2007/0215343 A1 9/2007 McDonald et al.
2007/0247328 A1 10/2007 Petrovic et al.
2008/0066905 A1 3/2008 Aivalis et al.
2008/0159077 A1 7/2008 Madhavan et al.
2008/0196904 A1 8/2008 Angman et al.
2008/0216554 A1 9/2008 McKee
2008/0230216 A1 9/2008 Angman
2008/0271924 A1 11/2008 Lurie et al.
2009/0012711 A1 1/2009 Harmon
2009/0038850 A1 2/2009 Brune et al.
2009/0255730 A1 10/2009 Brune et al.
2009/0277631 A1 11/2009 Minto et al.
2009/0321174 A1 12/2009 Endo et al.
2010/0065329 A1 3/2010 Zientarski
2010/0206544 A1 8/2010 Dowling et al.
2010/0328096 A1 12/2010 Hache et al.
2011/0005767 A1 1/2011 Muff et al.
2011/0277990 A1 11/2011 Kotsonis et al.
2011/0280104 A1 11/2011 McClung
2011/0315445 A1 12/2011 Runia et al.
2012/0068528 A1 3/2012 Grief et al.
2012/0085582 A1 4/2012 Brune et al.
2012/0197528 A1 8/2012 Le et al.
2012/0230151 A1 * 9/2012 Almaguer ..... E21B 7/061 367/86
2013/0068528 A1 3/2013 Gray
2013/0118807 A1 5/2013 Yang
2014/0121974 A1 5/2014 Itskovich
2014/0131103 A1 5/2014 Brune et al.
2014/0190686 A1 7/2014 Cannan et al.
2014/0308105 A1 10/2014 Soertveit et al.
2015/0012217 A1 * 1/2015 Legendre ..... E21B 47/082 702/7
2015/0070185 A1 3/2015 Schulz et al.
2015/0090459 A1 * 4/2015 Cain ..... B08B 7/0071 166/335
2015/0300161 A1 10/2015 Kamata
2015/0337650 A1 11/2015 Balogh et al.
2016/0061027 A1 3/2016 Gao et al.
2016/0138390 A1 5/2016 Arntsen et al.
2016/0291192 A1 10/2016 Cuevas et al.
2016/0298441 A1 10/2016 Orban
2016/0298442 A1 10/2016 Orban
2016/0298449 A1 10/2016 Orban
2017/0097441 A1 4/2017 Eiskamp
2017/0111112 A1 4/2017 San Martin et al.
2018/0045559 A1 2/2018 Hawthorn et al.

FOREIGN PATENT DOCUMENTS

WO 2004086093 A1 10/2004
WO 2005064114 A1 7/2005
WO 2009085348 A2 7/2009
WO 2012058296 A2 5/2012

* cited by examiner

TOP DRIVE WITH TOP ENTRY AND LINE INSERTED THERETHROUGH FOR DATA GATHERING THROUGH THE DRILL STRING

CROSS-REFERENCE TO RELATED APPLICATIONS

This application claims priority to U.S. Provisional Application having Ser. No. 62/146,731, which was filed on Apr. 13, 2015, to U.S. Provisional Application having Ser. No. 62/147,175, which was filed on Apr. 14, 2015, and to U.S. Provisional Application having Ser. No. 62/147,205, which was filed on Apr. 14, 2015. The entirety of these provisional patent applications is incorporated herein by reference.

BACKGROUND

Top drives are used to suspend and rotate a drill string in drilling applications. The top drive is supported by a drilling line wrapped on a set of sieves and connected to drawworks at one extremity. The top drive supports the drill string via a thrust bearing. Mud may be pumped into the drill string via a swivel. Furthermore, the top drive generally includes one or more motors (e.g., electric or hydraulic motors) which generate(s) the rotation of the drill string. The reaction torque applied to the top drive may be transmitted to a mast via a set of rollers or slides attached to the top drive chassis.

In some situations, it may be useful to acquire data about the drilling process from within the drill string. However, the drill string may act as a shield against acquiring this data. In addition, because the drill string contains pressurized mud, it may be challenging to deploy data acquisition tools into the drill string. Furthermore, the drill string is rotating, which further complicates this task.

SUMMARY

A method for transmitting data from a downhole instrument to a surface location is disclosed. The method includes running the downhole instrument into a wellbore on a line. The downhole instrument and at least a portion of the line are positioned inside a drill string. The downhole instrument includes first and second sets of fingers that contact an inner surface of the drill string. The downhole instrument measures an effect occurring in the drill string. The effect is due to perturbations in the drill string during a drilling process.

A drilling system is also disclosed. The drilling system includes a bottom-hole assembly that measures a property and generates an electrical current to communicate digital information including the measured property. A drill string is coupled to the bottom-hole assembly. A line is positioned within the drill string. A downhole instrument is positioned within the drill string and coupled to the line. The downhole instrument includes a first electrode that expands radially-outward into contact with a first point on an inner surface of the drill string. The downhole instrument also includes a second electrode that expands radially-outward into contact with a second point on the inner surface of the drill string. The downhole instrument measures a voltage differential between the first and second points on the drill string, and the voltage differential is caused by the electrical current flowing through the drill string as a result of the electrical current generated by the bottom-hole assembly.

A method for acquiring data in a wellbore is also disclosed. The method includes positioning a downhole instrument within a drill string. The drill string extends within the wellbore, which is formed in a subterranean formation. A characteristic of the drill string or a portion of the subterranean formation is sensed using the downhole instrument. Data representing the characteristic is transmitted through an instrument line coupled to the downhole instrument to a computing system located at or proximal to a top surface of the wellbore.

A method for transmitting data from a downhole instrument to a surface location is also disclosed. The method includes running the downhole instrument into a wellbore on a line. The downhole instrument and at least a portion of the line are positioned inside a drill string. A property is measured using the downhole instrument. The downhole instrument is coupled to the drill string. An electrical current is generated that flows into a subterranean formation. The electrical current includes a signal representing the measured property. A voltage differential is measured between first and second points on the drill string using the downhole instrument. The voltage differential is caused by the electrical current flowing through the drill string.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
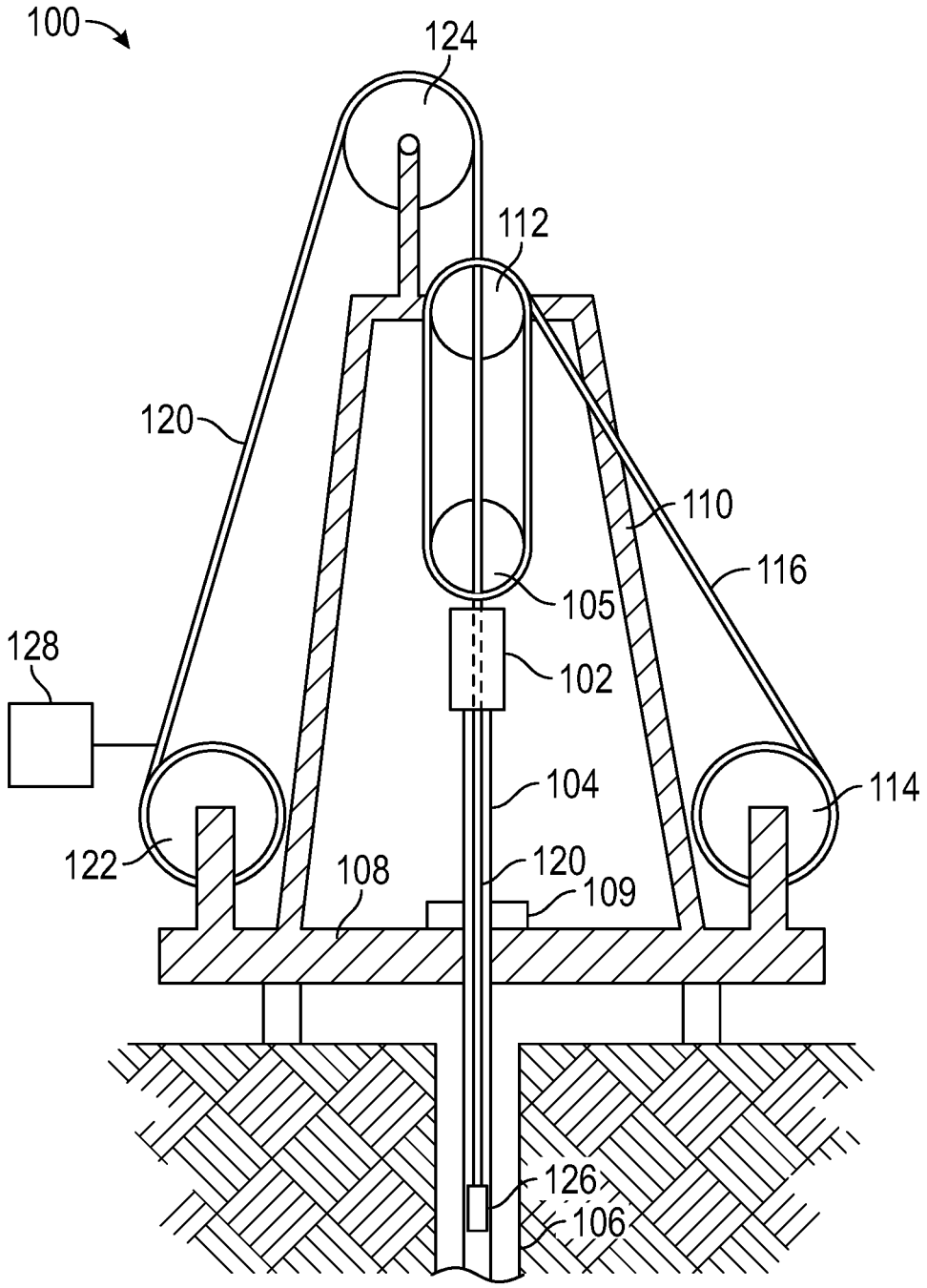
FIG. 1 illustrates a schematic view of a drilling rig, according to an embodiment.

FIG. 1 illustrates a schematic view of a drilling rig 100, according to an embodiment. The drilling rig 100 includes a drilling apparatus 102 and a drill string 104 coupled thereto. The drilling apparatus 102 may include any type of drilling device, such as a top drive or any other device configured to support, lower, and rotate the drill string 104, which may be deployed into a wellbore 106. In the illustrated embodiment, the drilling apparatus 102 may also include a travelling block 105, which may include of one or more rotating sheaves.

The drilling rig 100 may also include a rig floor 108, from which a support structure (e.g., including a mast) 110 may extend. A slips assembly 109 may be disposed at the rig floor 108, and may be configured to engage the drill string 104 so as to enable a new stand of tubulars to be added to the drill string 104 via the drilling apparatus 102.

A crown block 112 may be coupled to the support structure 110. Further, a drawworks 114 may be coupled to the rig floor 108. A drill line 116 may extend between the drawworks 114 and the crown block 112, and may be received through the sheaves of the travelling block 105. Accordingly, the position of the drilling apparatus 102 may be changed (e.g., raised or lowered) by spooling or unspooling the drilling line 116 from the drawworks 114, e.g., by rotation of the drawworks 114.

The drilling rig 100 may also include an instrument line 120, which may be received through the drilling apparatus 102 and into the drill string 104. The instrument line 120 may be spooled on an instrument line spool 122, and may be received at least partially around a line sheave 124 between the instrument line spool 122 and the drilling apparatus 102. In an embodiment, the instrument line spool 122 may be coupled to the rig floor 108 as shown, but in other embodiments, may be positioned anywhere on the rig 100 or in proximity thereto. Furthermore, in some embodiments, the line sheave 124 may be installed below or on the side of the crown block 112.

The instrument line 120 may be connected to a downhole instrument 126, which may be deployed into the interior of the drill string 104, as will be described in greater detail below. The drill string 104 may be rotated while the instrument line 120 is deployed in the drill string 104. The rotation may induce twisting of the instrument line 120. Accordingly, the downhole instrument 126 and/or a lower portion of the instrument line 120 may, in some embodiments, include a swivel, allowing for relative rotation between the downhole instrument 126 and the instrument line 120. In such an embodiment, the downhole instrument 126 may also be connected to the rotating drill string 104. Furthermore, mud may be pumped into the drill string 104 while the instrument line 120 and downhole instrument 126 are deployed inside the drill string 104. In an embodiment, the position of the downhole instrument 126 may be changed (e.g., raised or lowered) by spooling or unspooling the instrument line 120 from the instrument line spool 122. The downhole instrument 126 may be any type of instrument, such as a logging device, a geophone, an acoustic transmitter and receiver, a torque sensor, an axial load sensor, a vibration sensor, and/or the like. The downhole instrument 126 may be configured to obtain measurements in the wellbore 106, and the measurements may be or include current measurements, voltage differential measurements, rotational measurements (e.g., local instantaneous RPM of the drill string 104), radial shocks, local elastic deformation measurements (e.g., axial and torsion), steel acoustic transmission measurements (e.g., "CBL-type"), and the like. Further, the instrument line 120 may provide for wired communication with a controller 128, e.g., without calling for wires to be formed as a part of the drill pipe making up the drill string 104. The wired communication may be either single direction (i.e., uphole) or bi-directional.

Figure 2:
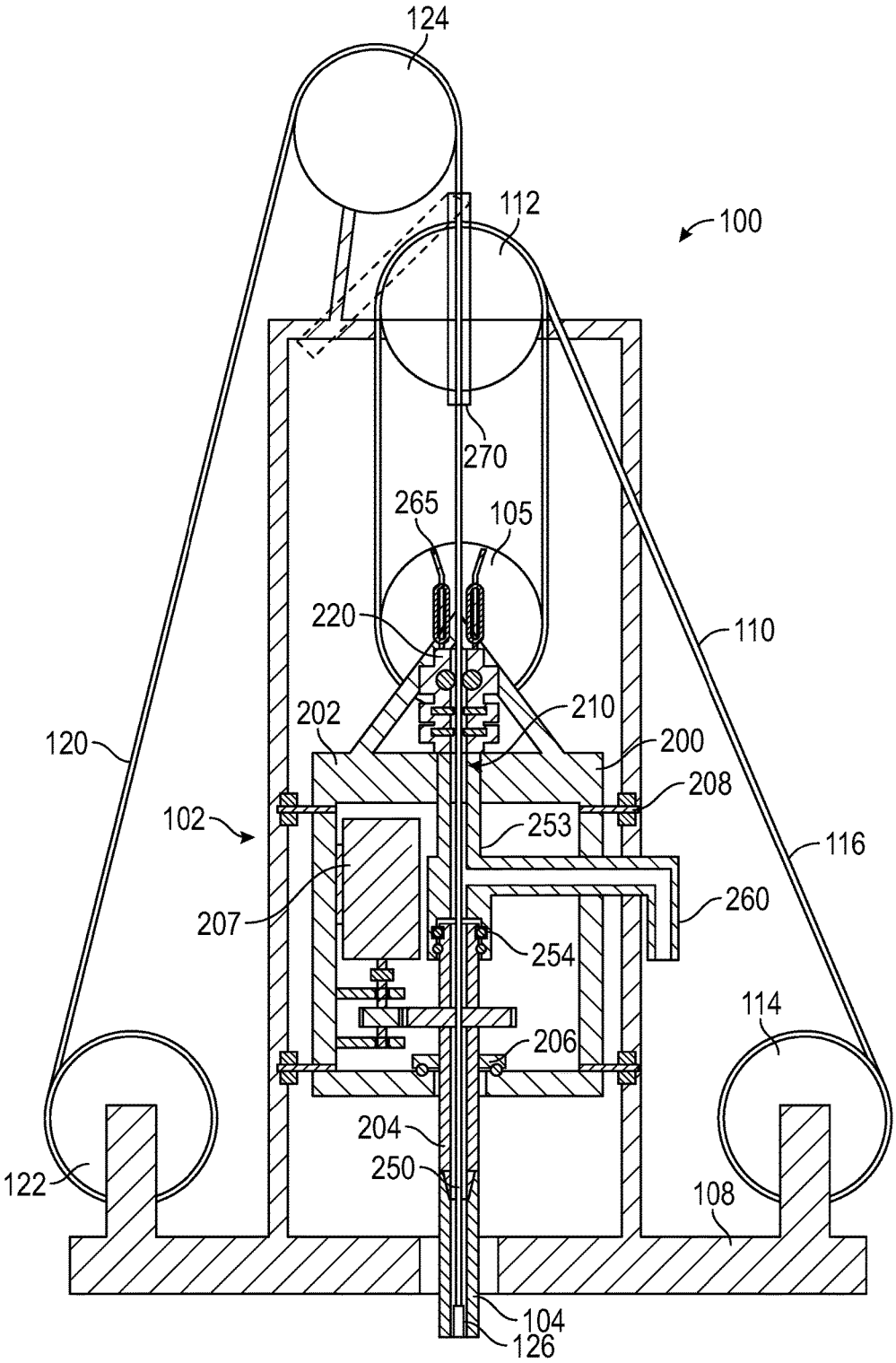
FIG. 2 illustrates an enlarged, partial, schematic view of the drilling rig, according to an embodiment.

FIG. 2 illustrates an enlarged, partial, schematic view of the drilling rig 100, according to an embodiment. As shown, the drilling apparatus 102 may be suspended from the rig floor 108 via interaction with the travelling block 105, the crown block 112, and the drilling line 116 that is spooled on the drawworks 114.

In addition, the drilling apparatus 102 may include a drilling device 200, e.g., a top drive. The drilling device 200 may include a housing 202 and a shaft 204, which may be coupled to and extend out of the housing 202. In particular, the shaft 204 may be rotatably coupled to the housing 202 via a thrust bearing 206. The shaft 204 may be drive to rotate by a motor 207, which may be coupled to and/or disposed within the housing 202. Further, the shaft 204 may be connected to the drill string 104, such that rotation of the shaft 204 may cause the drill string 104 to rotate. By such connection between the shaft 204 and the drill string 104, at least a portion of the weight of the drill string 104 may be supported by the housing 202, which transmits the weight to the rig floor 108 via the crown block 112 and the support structure 110, as well as the drawworks 114. The drilling device 200 may also include one or more rollers 208 (four are shown), which may transmit reactionary torque loads to the support structure 110. The housing 202 may further include an entry port 210, through which the instrument line 120 and the instrument 126 may be received.

Further, the drilling apparatus 102 may include a sealing device 220, through which the instrument line 120 and the instrument 126 may be received into the entry port 210. The sealing device 220 may be coupled to the housing 202 of the drilling device 200, and may be movable therewith. The sealing device 220 may have (e.g., be able to be operated in) at least three configurations. In an open configuration, the sealing device 220 may be configured to receive the instrument 126 therethrough. In a first, sealed configuration (illustrated in FIG. 2), the sealing device 220 may be configured to receive and seal with the instrument line 120. The instrument line 120 may be able to slide relative to the sealing device 220 when the sealing device 220 is in the first configuration, but fluid may be prevented from proceeding through the entry port 210 by the sealing device 220. In a second, sealed configuration, the sealing device 220 may completely seal the entry port 210, e.g., when the instrument line 120 is not received therethrough. Thus, the sealing device 220 may function similarly to a blowout preventer does for the drill string 104, serving to control access into the entry port 210. The different configurations may be reached based on a position of an annular "preventer" or seal of the sealing device 220, as will be described in greater detail below.

The entry port 210 may communicate with an interior 250 of the shaft 204, e.g., via a conduit 253 within the housing 202. The shaft 204 may be rotatably coupled to the conduit 253 via swivel 254, as shown. Accordingly, the instrument line 120, when received through the entry port 210, may proceed through the conduit 253 and into the shaft 204, and then into the drill string 104.

The drilling device 200 may also receive a flow of drilling mud via a mud conduit 260. The mud conduit 260 may communicate with the conduit 253 within the housing 202, and thus the mud conduit 260 may be in fluid communication with the entry port 210, as well as the interior 250 of the shaft 204 and the drill string 104. The sealing device 220 may serve to prevent mud flow up through the entry port 210 in either or both of the first and second configurations thereof.

The drilling apparatus 200 may further include a line-pusher 265. The line-pusher 265 may be configured to apply a downwardly-directed force on the instrument line 120, which may cause the instrument line 120 to be directed downward, through the sealing device 220, the entry port 210, the conduit 253, the interior 250 of the shaft 204, and through at least a portion of the drill string 104, so as to deploy the instrument 126 (FIG. 1) therein. Further, the line-pusher 265 may be coupled to the housing 202 of the drilling device 200 and may be movable therewith. In an embodiment, the line-pusher 265 may be directly attached to the sealing device 220, e.g., such that the sealing device 220 is positioned between the housing 202 and the line-pusher 265. As such, the line-pusher 265 may be configured to push the instrument line 120 through the entry port 210 via the sealing device 220.

The line-pusher 265 may be employed to overcome initial fluid resistance provided by the drilling mud coursing through the mud conduit 260 as well as friction between the instrument line 120 and the downhole instrument 126 while moving axially inside the bore of the drill string 104. Further, the line-pusher 265 may provide for rapid deployment of the instrument line 120 through the drill string 104, e.g., at a similar rate, or even faster than the velocity of the drilling mud therein, and thus the line-pusher 265 may overcome drag forces of the instrument 126 and the drilling line 116 in contact with the mud.

The line-pusher 265 may also be used to retract the instrument line 120 and the instrument 126 out of the drill string 104, e.g., by reversing direction and pushing the instrument line 120 upwards, away from the entry port 210. The retracted instrument line 120 may thus be spooled on the instrument line spool 122, e.g., with minimum pull force by the instrument line spool 122.

The drilling apparatus 102 may also include a pivotable guide 270, through which the instrument line 120 may be received. The pivotable guide 270 may be positioned, as proceeding along the line 120, between the line sheave 124 and the line-pusher 265. The pivotable guide 270 may be movable across a range of positions, for example, between a first position, shown with solid lines, and a second position, shown with dashed lines. In the first position, the pivotable guide 270 may direct the instrument line 120 between the sheaves of the crown block 112 and between the sheaves of the travelling block 105 and toward the entry port 210. In the second position, the pivotable guide 270 may direct the instrument line 120 away from the entry port 210. For example, the second position may be employed when raising the drilling device 200 so as to accept a new stand of tubulars on the drill string 104 and/or when initially bringing the downhole instrument 126 and the instrument line 120 from the rig floor into the entry port 210, as will be described in greater detail below.

Figure 3B:
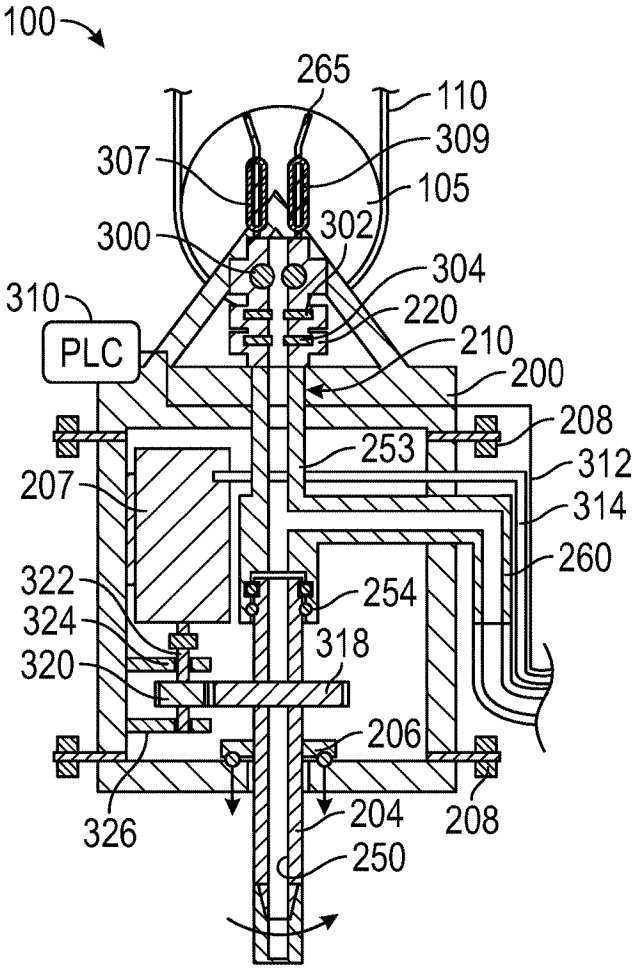
FIGS. 3A and 3B illustrates two partial side views of a portion of the drilling rig (i.e., a drilling apparatus), according to an embodiment.
Figure 3A:
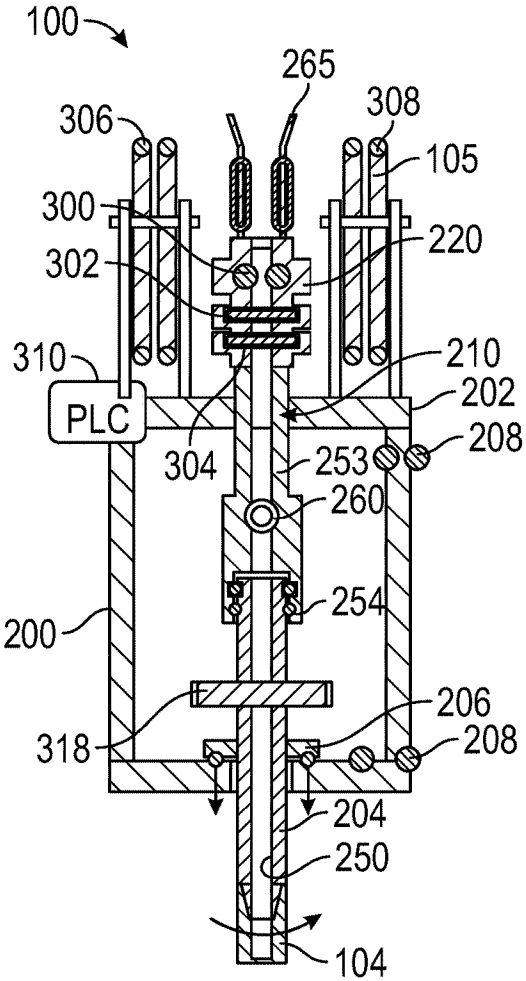

FIGS. 3A and 3B illustrates two partial side views of the drilling apparatus 102, specifically showing additional details of the sealing device 220 and the line-pusher 265, among other things, according to an embodiment. As illustrated, the sealing device 220 and the line-pusher 265 may be positioned between two sets of sheaves 306, 308 of the travelling block 105, and thus may be positioned to receive the instrument line 120 and feed the instrument line 120 to the entry port 210.

Further, the sealing device 220 may include an annular seal (e.g., an annular "preventer") 300 and one or more rams (two shown: 302, 304). The annular seal 300 may be movable in response to a command, e.g., radially inwards and outwards. Accordingly, the annular seal 300 may be moved outwards to receive the instrument line 120 and inwards to seal the entry port 210.

The ram 302 may be a pipe ram or a shear ram, and the ram 304 may be a blind ram. In an embodiment, the ram 304 being a blind ram may allow the sealing device 220 to close the entry port 210 when the instrumented line 120 is not present in the sealing device 220. Such situation may occur during drilling operations when usage of the instrument line 120 and/or the instrument 126 is not desired. The ram 302 acting as a shear ram may provide the sealing device 220 with the ability to cut the instrument line 120 while sealing the entry port 210, e.g., to address hazardous conditions. Further, in the embodiment in which the ram 302 is a pipe ram, the pipe ram 302 may be used to seal accurately against the instrumented line 120, for example, in situations in which the inside of the drill string 104 is at high pressure. The pipe rams also may support the instrument 120 line within the drill string 104, and thus may serve as a back-up if the line-pusher 265 is temporarily incapable of supporting the instrumented line within the drill sting 104.

Further, the line-pusher 265 may include two or more tracks or "caterpillars" 307, 309, which may engage and move the instrument line 120 into and/or out of the entry port 210. The tracks 307, 309 may include links, rollers, or any other structure capable of engaging the instrument line 120 and, e.g., through friction created by such an engagement, force the instrument line 120 downwards into the entry port 210, or to pull the instrument line 120 upwards, out of the entry port 210, as the tracks 307, 309 are moved.

In the illustrated embodiment, the shaft 204 is connected to a gear 318, which meshes with a gear 320 that is connected to a motor shaft 322. The motor shaft 322 is rotated by the motor 207, and such rotate is transmitted to the shaft 204 via the meshing gears 318, 320. In this embodiment, the motor 207 is coupled to the housing 202 using motor mounts 324, 324.

The drilling apparatus 102 may also include a controller 310, which may be coupled to the housing 202 and movable therewith, or otherwise in communication with the drilling device 200. The controller 310 may receive commands, e.g., from the controller 128 (FIG. 1) via a control line 312, but in some embodiments, may be autonomous. Further, the controller 310 may control the operation of the line-pusher 265, e.g., to control when the line-pusher 265 operates to feed the instrument line 120 through the entry port 210. The controller 310 may also operate to control the sealing device 220, e.g., to control when the annular seal 300 moves radially and to control the operation of one or both rams 302, 304. The controller 310 may further control or monitor the power to the motor 207 via a power line 314, so as to control when, and at what speed, the motor 207 rotates the shaft 204.

Figure 4:
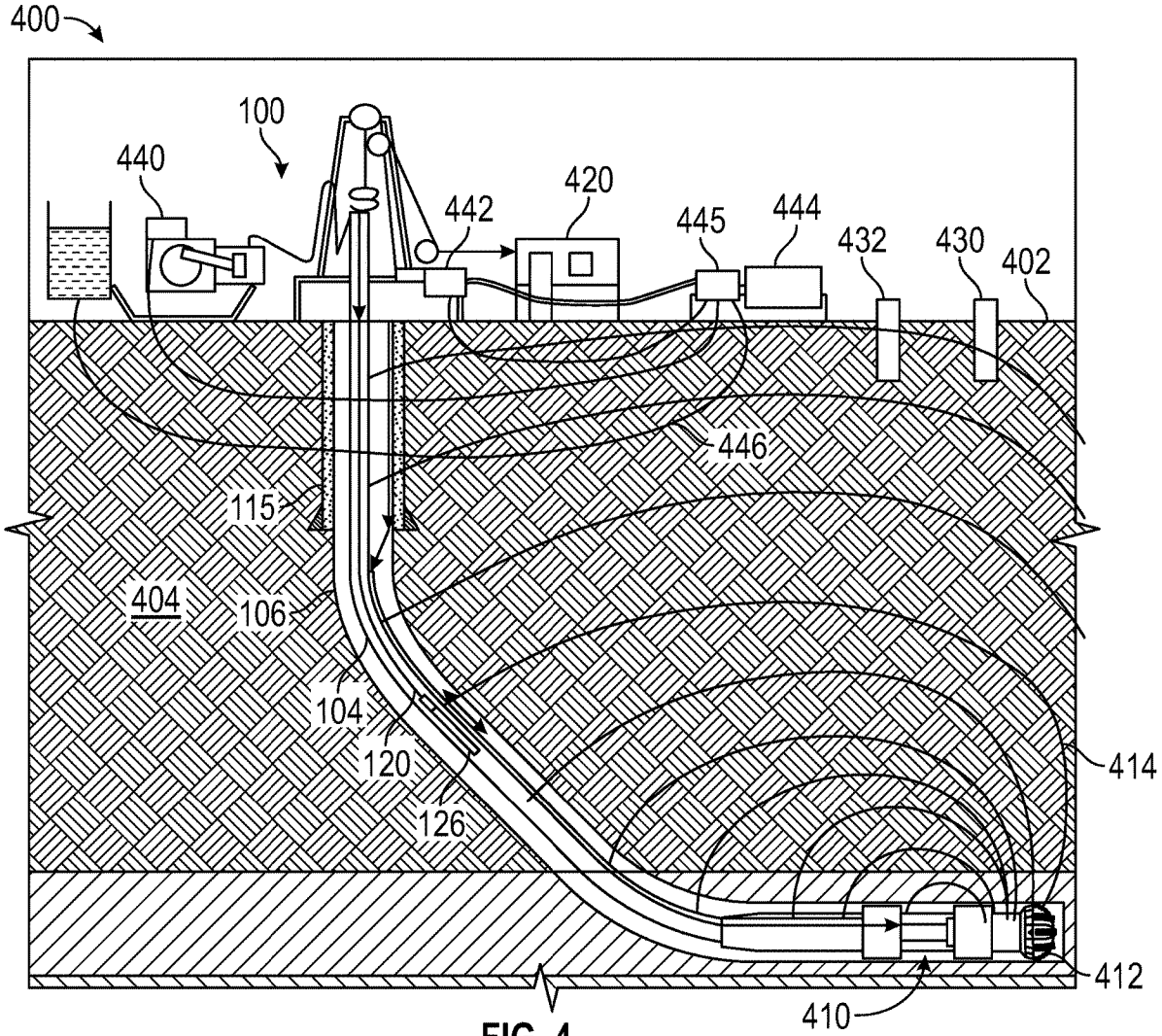
FIG. 4 illustrates a conceptual, side, schematic view of a well site including the drilling rig, according to an embodiment.

FIG. 4 illustrates a conceptual, side, schematic view of a well site 400 including the drilling rig 100, according to an embodiment. A bottom-hole assembly ("BHA") 410 may be coupled to a lower end of the drill string 104. The BHA 410 may be or include several downhole tools above a drill bit 412. The downhole tools may be or include a rotary steerable system ("RSS"), a motor, a logging-while-drilling ("LWD") tool, and a measurement-while-drilling ("MWD") tool. The LWD tool may be configured to measure one or more formation properties and/or physical properties as the wellbore 106 is being drilled or at any time thereafter. The MWD tool may be configured to measure one or more physical properties as the wellbore 106 is being drilled or at any time thereafter. The formation properties may include resistivity, density, porosity, sonic velocity, gamma rays, and the like. The physical properties may include pressure, temperature, wellbore caliper, wellbore trajectory, a weight-on-bit, torque-on-bit, vibration, shock, stick slip, and the like. The measurements from the LWD tool may be sent to the MWD tool. The MWD tool may then group the sets of data from the LWD tool and the MWD tool and prepare the data into frames for transmission to the surface after proper encoding.

The BHA 410 (e.g., the MWD tool) may transmit data (e.g., formation properties, physical properties, etc.) from within the wellbore 106 up to a computer system 420 at the surface 402 using electromagnetic telemetry. To transmit the digital data stream from within the wellbore 106 to the surface 402, a coding method may be used. More particularly, a predetermined carrier frequency is selected, and a PSK or QPSK coding is superposed to define the bit pattern of the prepared frames describing the measured properties. This coded signal is applied as a voltage differential between upper and lower portions of the BHA 410 (e.g., across an insulation layer in the BHA 410 called the "e-mag gap"). Due to the voltage differential between the upper and lower portions of the BHA 410, a current 414 may be generated that travels from the lower portion of the BHA 410 out into the subterranean formation 404. At least a portion of the current 414 may reach the surface 402.

One or more signal detectors (two are shown: 430, 432) may be positioned at the surface 402. As shown, the signal detectors 430, 432 may be metal stakes that are driven into the ground. The current 414 in the subterranean formation 404 can be detected by the induced voltage differential between the electrodes 430, 432, between at least one of the electrodes 430, 432 and the casing 115, or between at least one of the electrodes 430, 432 and the attached wellhead and BOP, which act as the second electrode. This voltage differential is generated due to the current flow in the subterranean formation 404 which has some intrinsic resistivity. The voltage differential may be measured at by an ADC connected to the signal detectors 430, 432, the casing 115, the wellhead, the BOP, or a combination thereof. The output of the ADC may be transmitted to the computer system 420 at the surface 402. By processing of the ADC output, the computer system 420 may then decode the voltage differential to recover the transmitted frame containing the data by the BHA 410 (e.g., the formation properties, physical properties, etc.).

The well site 400 may also include one or more motors (two are shown: 440, 442) and/or generators (one is shown: 445) driven by engines (one is shown: 444) positioned at the surface 402. The motors 440, 442 and/or generator 445 may also generate perturbation current 446 that flows through the subterranean formation 404. The current 446 from the motors 440, 442 and/or generator 445 may also create a voltage differential detected between the signal detectors 430, 432 or between at least one of the signal detectors 430, 432 and the casing 115. This voltage differential due to the current 446 may be seen as noise because it may be difficult to distinguish from the current 414 transmitted from the BHA 410, which makes recovering and interpreting the data in the current 414 from the BHA 410 more difficult.

In at least one embodiment, the downhole instrument 126 may be positioned in the wellbore 106 between the BHA 410 and the surface 402. At least a portion of the current 414 transmitted from the BHA 410 may flow from the subterranean formation 404, into the drill string 104 above the instrument 126, and then along the drill string 104 back to the BHA 410. The downhole instrument 126 may include two or more electrodes that are configured to measure the current and/or voltage differential therebetween as the current 414 flows through the drill string 104. As the downhole instrument 126 is closer to the BHA 410 than signal detectors 430, 432 positioned at the surface 402, and further away from the surface noise (e.g., current 446) than signal detector 430, 432, the downhole instrument 126 may have an improved signal-to-noise ratio compared to the signal detectors 430, 432 at the surface 402. The measured current and/or voltage differential at the downhole instrument 126 may be transmitted via the instrument line 120 up to the surface 402 (e.g., to the computer system 420).

Figure 5:
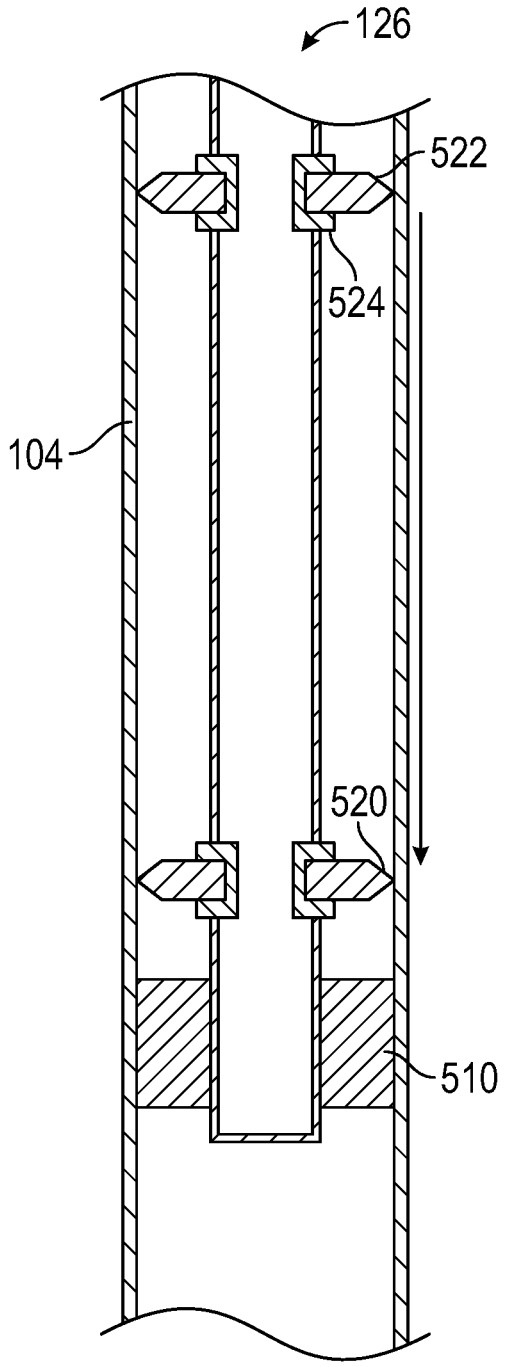
FIG. 5 illustrates a conceptual, side, schematic view of a downhole instrument inside a drill string, according to an embodiment.

FIG. 5 illustrates a conceptual, side, schematic view of the downhole instrument 126 inside the drill string 104, according to an embodiment. The downhole instrument 126 may be secured in place in the drill string 104 using an anchor 510.

The anchor 510 may be set and unset as desired by a user. The anchor 510 may be set by expanding radially-outward and contacting the inner surface of the drill string 104. In another embodiment, the anchor 510 may be set and unset using a J-slot mechanism. The anchor 510 may also be set electrically, mechanically, hydraulically, or using a combination thereof. For example, an activation command may be transmitted from the surface 402 through the instrument line 120. When the activation command is received, power may be supplied to a motor, which may drive an oil pump. The pressurized oil may activate an internal piston that sets the anchor 510. In some embodiments, the anchor 510 may allow drilling mud to pass within the drill string 104, past the instrument 126.

The downhole instrument 126 may also include two or more sets of electrodes (two are shown: 520, 522). The electrodes 520, 522 may also be referred to as dogs or fingers. The electrodes 520, 522 may be at least partially positioned within or surrounded by an electrically-insulating material 524. The electrodes 520, 522 may be axially-offset from one another with respect to a central longitudinal axis through the downhole instrument 126 and/or the drill string 104. The electrodes 520, 522 may measure an effect occurring in the drill string 104 that is due to perturbations in the drill string 104 during a drilling process. In one example, as part of the current 414 from the BHA 410 flows through the drill string 104, the current generates a voltage differential, which may be measured between the electrodes 520, 522. The downhole instrument 126 may be positioned in the wellbore 106 below the casing 115. At this depth, the current and voltage differential sensed by the electrodes 520, 522 may be primarily from the BHA 410, as opposed to the surface equipment (e.g., motors 440, 442 and/or generator 445), as the downhole instrument 126 is at a fair distance from the surface 402. In one embodiment, the electrodes 520, 522 may be configured to measure when the current 414 has been injected by a dipole in the drill string 104 (i.e., by the MWD in the BHA 410). In another embodiment, the electrodes 520, 522 may be configured to measure when the current 414 has been injected by a source at the surface location 402 such as between the electrodes 430, 432, between at least one of the electrodes 430, 432 and the casing 115, or between at least one of the electrodes 430, 432 and the attached wellhead and BOP, which act as the second electrode.

In at least one embodiment, different positions of the downhole instrument 126 within the drill string 104 may be determined based upon the measured current. In another embodiment, different relative positions of one or more sources transmitting the current may be determined based upon the measured current. In yet another embodiment, one or more properties of the subterranean formation 404 may be determined based upon the measured current.

In at least one embodiment, the downhole instrument 126 is submitted to the same deformation as the drill string 104 when a load on the drill string 104 varies. The load on the drill string 104 may be the axial load (e.g., tension or compression) and torque generated on the drill string 104 during some process associated with drilling. The corresponding deformations are either change of length or torsion. The downhole instrument 126 may be configured to measure the deformation and transmit the measured deformation to the computing system at the surface location 402. The measured deformation may be correlated to a measurement of the load on the drill string 104, and the friction between the drill string 104 and the wellbore 106 along the drill string 104 may be determined using the variation of the load versus axial position. The friction may occur during drilling, reaming, or trip conditions.

Figure 6:
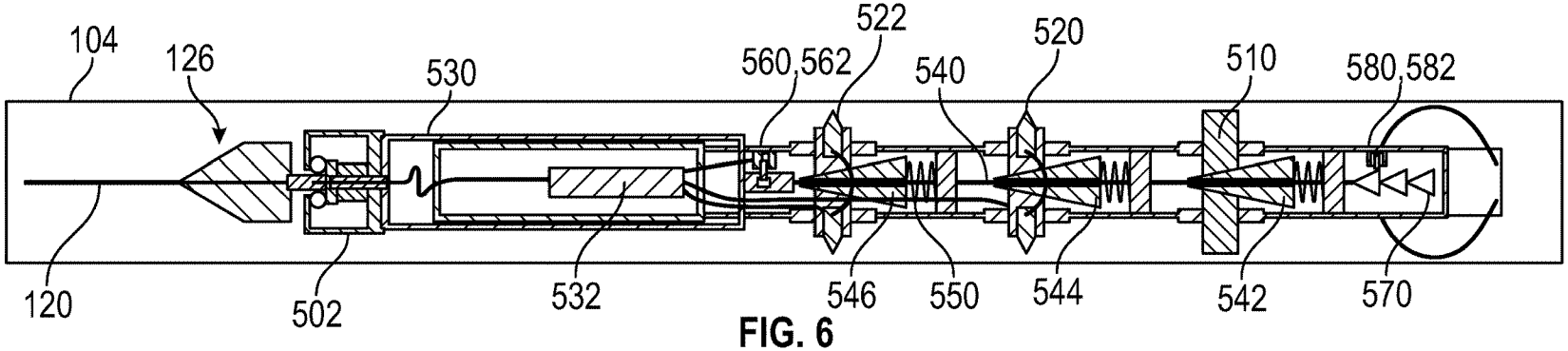
FIG. 6 illustrates a conceptual, side, schematic view of the downhole instrument in an unset mode, according to an embodiment.

FIG. 6 illustrates a conceptual, side, schematic view of the downhole instrument 126 in an unset mode, according to an embodiment. The downhole instrument 126 may include a housing 530. An electronics module 532 may be positioned within the housing 530. A transmission bar 540 may also be positioned within the housing 530. The transmission bar 540 may be parallel to the central longitudinal axis through the downhole instrument 126 and/or the drill string 104. One or more opening blocks (three are shown: 542, 544, 546) may be coupled to the transmission bar 540. The opening blocks 542, 544, 546 may be axially-offset from one another with respect to the central longitudinal axis. The opening blocks 542, 544, 546 may have a conical or frustoconical outer surface. The opening blocks 542, 544, 546 may be at least partially axially-aligned with the anchor 510 and the electrodes 520, 522, respectively. Biasing members 550 may be positioned within the housing 530 and adjacent to the respective opening blocks 542, 544, 546. The biasing members 550 may be or include springs that are configured to exert an axial force on the opening blocks 542, 544, 546. As shown, the biasing members 550 are configured to push on the thicker ends of the opening blocks 542, 544, 546.

The transmission bar 540 and the opening blocks 542, 544, 546 may be secured in a first axial position by a first lock pin 560 positioned within a notch or opening in the transmission bar 540 when the downhole instrument 126 in the unset mode, as shown in FIG. 6. The anchor 510 and the electrodes 520, 522 may be retracted when the downhole instrument 126 is in the unset mode (i.e., when the transmission bar 540 and the opening blocks 542, 544, 546 are in the first axial position). When the anchor 510 and the electrodes 520, 522 are retracted, they may not be in contact with the inner surface of the drill string 104. This may allow the downhole instrument 126 to be moved (e.g., lowered) within the drill string 104 to the desired position. A swivel 502 in the downhole instrument 126 may allow the downhole instrument 126 to rotate with the drill string 104 while the instrument line 120 may not rotate. The downhole instrument 126 may be rotating about the central longitudinal axis of the drill string 104. The instrument line 120 may not rotate if passing through the drilling apparatus 102 and being connected to the instrument line spool 122. The instrument line 120 may be twisted at a twisting angle due to the friction generated by the relative rotation between the drill string 104 against the instrument line 120 and potentially the downhole instrument 126.

Figure 7:
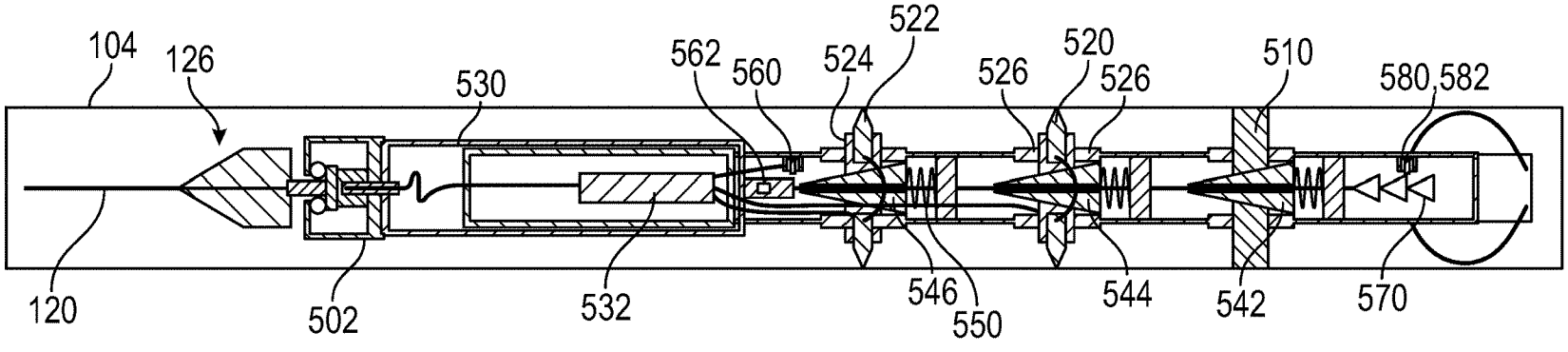
FIG. 7 illustrates a conceptual, side, schematic view of the downhole instrument in a set mode, according to an embodiment.

FIG. 7 illustrates a conceptual, side, schematic view of the downhole instrument 126 in a set mode, according to an embodiment. When the downhole instrument 126 is in the desired position within the drill string 104, the user may transmit an activation command through the instrument line 120. The activation command may be received in the electronics module 532 in the downhole instrument 126. In response to receiving the activation command, the electronics module 532 may cause a first solenoid 562 to remove the first pin 560 from the notch or opening in the transmission bar 540. Once the first pin 560 is removed, the force exerted on the transmission bar 540 and the opening blocks 542, 544, 546 by the biasing members 550 may cause the transmission bar 540 and the opening blocks 542, 544, 546 to move (e.g., to the left as shown in FIG. 7) to a second axial position within the housing 530.

As the transmission bar 540 and the opening blocks 542, 544, 546 move from the first axial position to the second axial position, the tapered outer surfaces of the opening blocks 542, 544, 546 may push the anchor 510 and the electrodes 520, 522 radially-outward and into contact with the inner surface of the drill string 104, thus actuating the downhole instrument 126 into the set mode. One or more guides 526 positioned adjacent to the anchor 510 and the electrodes 520, 522 may direct the radial movement of the anchor 510 and the electrodes 520, 522. Also the electrodes 520, 522 may be insulated from the remainder of the downhole instrument 126 by electrically-insulating material 524 (see FIG. 5).

A ratchet 570 may be coupled to the transmission bar 540. As the transmission bar 540 and the ratchet 570 move from the first axial position to the second axial position, a second lock pin 580 may engage one or more notches in the ratchet 570. This may secure the transmission bar 540 in the second axial position. To unset the anchor 510 and/or the electrodes 520, 522, a second solenoid 582 may be activated to cause the second lock pin 580 to release the ratchet 570. Fluid may be pumped into the wellbore 106 and may exert a downward force on the downhole instrument 126. When the force exerted by the fluid becomes greater than the force exerted by the biasing members 550, the transmission bar 540 may move back into the first axial position, where it may be secured in place by the first lock pin 560.

Figure 8:
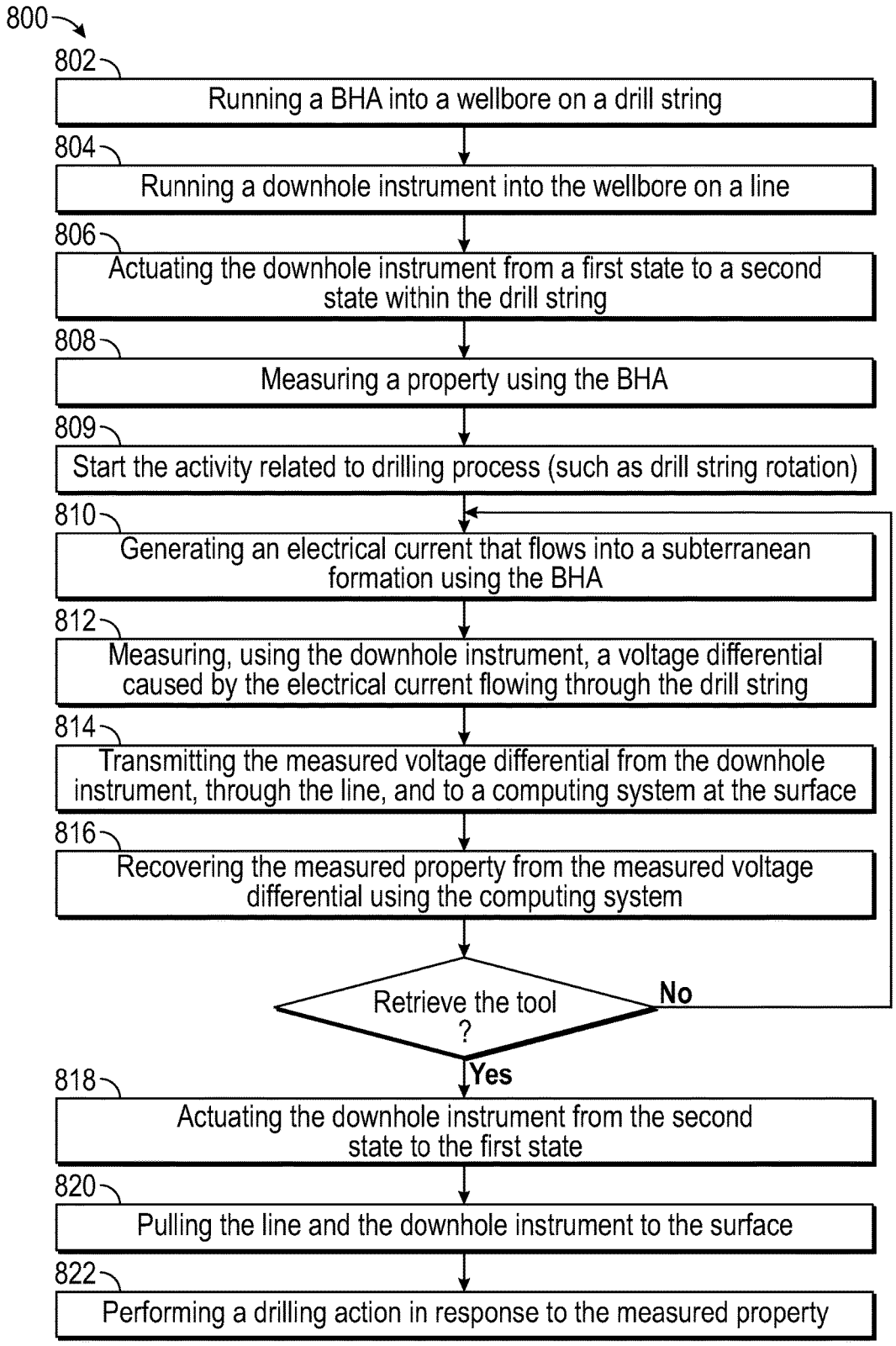
FIG. 8 illustrates a flowchart of a method for transmitting data from a downhole tool to a surface location, according to an embodiment.

FIG. 8 illustrates a flowchart of a method 800 for transmitting data from a BHA 410 to a surface location, according to an embodiment. The method 800 may include running a BHA 410 into a wellbore 106 on a drill string 104, as at 802. The method 800 may also include running a downhole instrument 126 into the wellbore 106 on an instrument line 120, as at 804. The downhole instrument 126 and the instrument line 120 may be positioned inside/within the drill string 104.

The method 800 may also include actuating the downhole instrument 126 from a first, unset state to a second, set state within the drill string 126, as at 806. Actuating the downhole instrument 126 may include expanding the anchor 510 radially-outward to secure the downhole instrument 126 in place within the drill string 104. Actuating the downhole instrument 126 may also include expanding the electrodes 520, 522 radially-outward and into contact with first and second points on the inner surface drill string 104. The downhole instrument 126 may be positioned between the surface 402 (e.g., an origination point of the wellbore 106) and the BHA 410 when the downhole instrument 126 is actuated. For example, a distance between the origination point of the wellbore 106 and the downhole instrument 126 (as measured along the drill string 104) may be from about 30% to about 90% or about 40% to about 80% of a distance between the origination point of the wellbore 106 and the BHA 410. When the downhole instrument 126 is actuated into the second axial position, the drilling rig may start activities related to the drilling process, such as rotating the drill string 104 and/or moving the drill string 104 axially. The drilling rig may also start flow of drilling mud inside the drill string 104. Such activities may be combined to perform drilling, reaming, and tripping.

The method 800 may also include measuring one or more properties (e.g., formation properties and/or physical properties) using the tools (e.g., MWD, LWD) in the BHA 410, as at 808. The method 800 may also include starting activity related to a drilling process (e.g., rotating the drill string 104), as at 809. The method 800 may also include generating an electrical current that flows into a subterranean formation 404 using the tools in the BHA 410, as at 810. This may include generating a digital frame, using the tools in the BHA 410, which includes the measured property. The digital frame may be encoded to superpose the measured property into/onto a carrier signal. The carrier signal may be converted to a voltage differential that is generated across an insulation layer in the BHA 410 (i.e., insulation gap of the MWD tool in the BHA 410), and the voltage differential may generate the current that flows through the subterranean formation 404. As discussed above, at least a portion of the current may flow into and through the drill string 104 (e.g., back toward the BHA 410).

The method 800 may also include measuring, using the downhole instrument 126, a voltage differential caused by the electrical current flowing through the drill string 104, as at 812. More particularly, the downhole instrument 126 may measure the voltage differential between the electrodes 520, 522. The method 800 may also include transmitting the measured voltage differential from the downhole instrument 126, through the instrument line 120, and to a computing system 420 at the surface 402, as at 814. In another embodiment, the downhole instrument 126 may process the measured voltage versus time to decode the signal and recover the digital frame sent by the MWD. The downhole instrument 126 may also verify the validity of the decoded frame and extract the measured property. The downhole instrument 126 may then re-encode the data into a second frame which is transmitted to surface via the instrument line 120. The method 800 may then include recovering/decoding the measured property from the transmitted signal along the instrument line 120 using the computing system 420, as at 816. This may include recovering/decoding the digital frame from the signal transmitted along the instrument line 120. If the user wants to retrieve the downhole instrument 126 (i.e., back to the surface location) or move the downhole instrument 126 to a different position within the drill string 104 for additional measurements, the method 800 may proceed to 808 below. Otherwise, the method 800 may loop back to 810. The method 800 may also include actuating the downhole instrument 126 from the second, set state to the first, unset state, as at 818. The method 800 may also include pulling the instrument line 120 and the downhole instrument 126 to the surface 402, as at 820. In another embodiment, rather than pulling the downhole instrument 126 to the surface 402, the method 800 may include moving the downhole instrument 126 to a different location within the drill string 104 for additional measurements or increased reception of the MWD telemetry frames.

The method 800 may also include performing a drilling action in response to the measured property, as at 822. The drilling action may include varying a trajectory of the BHA 410 to vary a trajectory of the wellbore 106 in response to the measured property. In another embodiment, the drilling action may include varying a weight-on-bit ("WOB") of the BHA 410 at one or more locations in the subterranean formation 404 in response to the measured property. In another embodiment, the drilling action may include varying a flow rate of fluid being pumped into the wellbore 106 in response to the measured property. In another embodiment, the drilling action may include varying a type (e.g., composition) of the fluid being pumped into the wellbore 106 in response to the measured property. In another embodiment, the drilling action may include measuring one or more additional properties in the subterranean formation 404 using the BHA 410 in response to the measured property.

Figure 9:
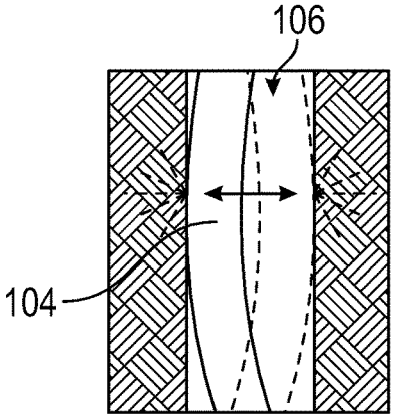
FIG. 9 illustrates the drill string experiencing shock in the wellbore, according to an embodiment.
Figure 11:
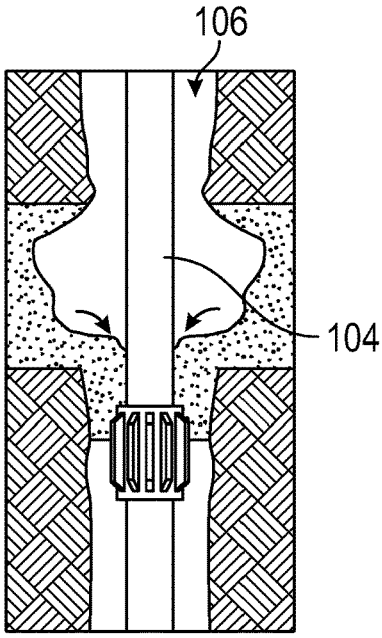
FIG. 11 illustrates the drill string at a stuck point in the wellbore, according to an embodiment.
Figure 10:
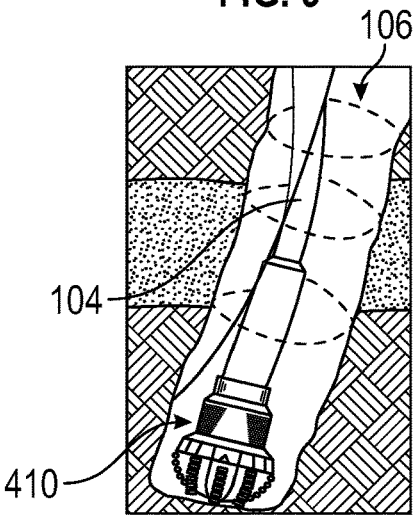
FIG. 10 illustrates the drill string in a keyseat in the wellbore, according to an embodiment.
Figure 12:
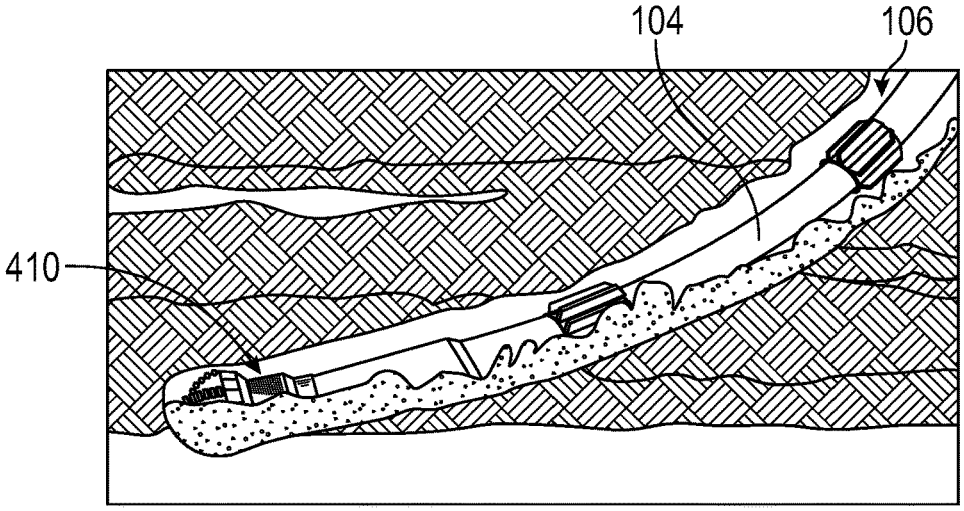
FIG. 12 illustrates the drill string in a cutting bed in the wellbore, according to an embodiment.

FIGS. 9-12 illustrate side, schematic views of the drill string 104 experiencing dynamic behavior, according to an embodiment. More particularly, FIG. 9 illustrates the drill string 104 experiencing radial shock in the wellbore 106. FIG. 10 illustrates the drill string 104 in a keyseat in the wellbore 106 so that the BHA 410 has difficulty moving upwards through the keyseat due to its large diameter with local additional axial force on the drill string 104. FIG. 11 illustrates the drill string 104 at a point of high friction in the wellbore 106 due to the collapse or deformation (e.g., an accumulation) of the wellbore wall with the risk of being stuck and local high friction, which may generate extra torque or axial load on the drill string 104. FIG. 12 illustrates the drill string 104 in a cutting bed (i.e., an accumulation) in the wellbore 106 due to an inadequate wellbore cleaning process while drilling, also creating high friction against the drill string 104. To improve drilling performance and reduce the risk associated with these issues, friction (e.g., axial movement and rotation) between the drill string 104 and wellbore 106 may be detected and used.

The downhole instrument 126 may obtain measurements inside the drill string 104 related to drill string mechanics while the drilling process is performed (e.g., drilling, reaming, etc.). The downhole instrument 126 may be moved inside the drill string 104 and may be actuated (e.g., clamped) in the bore of the drill string 104 to obtain measurements at multiple axial positions within the drill string 104. The downhole instrument 126 may also measure the dynamic behavior of the drill string 104. This may include measuring local instantaneous RPM of the drill string 104, radial and/or axial accelerations (e.g., using an accelerometer in the downhole instrument 126), vibrations, and shocks. These measurements may allow the drill string 104 and the BHA 410 to avoid operating at a resonance or whirling conditions. For example, the RPM and WOB may be modified (e.g., optimized) based upon the measurements. The influence of the mud rheology on the whirling may also be verified. In another example, a drilling behavior of the drill string 104 may be determined at different depths based upon the measured shock and vibration, local drill string RPM, whirling, or a combination thereof. In particular, whirling movements can be determined from continuous/synchronous measurement on two radial accelerometers in a gyroscope.

The downhole instrument 126 may also measure elastic deformation (e.g., axial and torsion) of the drill string 104. This may be used to determine local friction between the drill sting 104 and the wellbore 106. With multiple sets of deformations at different positions along the drill string 104, local variation of such deformations may indicate a local increase of friction in the annulus between the drill string 104 and wellbore 106. This may also be used to localize bed cutting, the wellbore 106 closing on the drill string 104, and differential sticking.

The downhole instrument 126 may be anchored at one or more locations within the drill string 104. In one embodiment, the downhole instrument 126 may include two anchors 510, with one at each axial end of the downhole instrument 126. The drill string deformations (e.g., axial and torsion) may be measured by the downhole instrument 126. For example, the downhole instrument 126 may include transducers to measure these deformations. The transducers may include strain gauges. In another embodiment, the transducers may include a linear variable differential transformer ("LVDT") gauge between two rigid parts of the downhole instrument 126. This measurement methodology may serve as a wireline free-point indicator.

Figure 13:
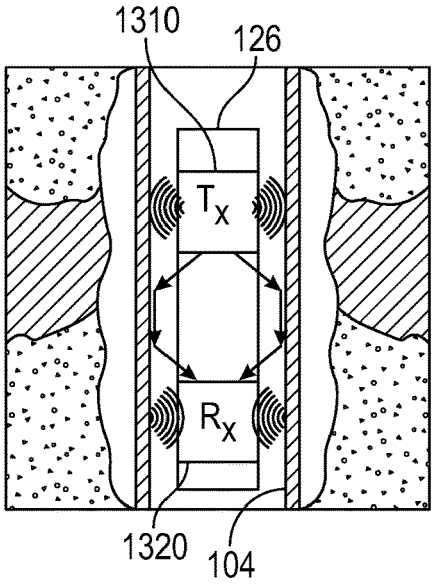
FIG. 13 illustrates a conceptual, side, schematic view of the downhole instrument performing sonic logging inside the drill string, according to an embodiment.

FIG. 13 illustrates a conceptual, side, schematic view of the downhole instrument 126 performing sonic logging inside the drill string 104, according to an embodiment. The downhole instrument 126 may include a transmitter 1310 that transmits a sonic wave. The sonic wave may travel radially-outward from the downhole instrument 126 to the drill string 104, and then set in ringing the drill string 104, which in turn re-emits signals into the fluid inside the drill string 104. The downhole instrument 126 may also include an acoustic receiver 1320 that receives the acoustic signals in fluid inside the drill string 104. The receiver 1320 may be a hydrophone. In at least one embodiment, the transmitter 1310 and the receiver 1320 are separated by a distance along the downhole instrument 126 for adequate attenuation of the parasitic signal transmitted by the transmitter 1310 into the body of the downhole instrument 126. For proper axi-symmetrical detection of the signal, the downhole instrument 126 may be centralized in the bore of the drill string 104. Such centralization may be obtained by the activation of the set of fingers which may extend radially against the wall of the drill string 104. In some embodiments, these sets of fingers may be extended and retracted as already explained above. Once the re-emitted signal by the drill string 104 is received, a determination may be made to determine the decay time of the re-emitted signal. The decay rate is related to the direct external contact of the drill string 104 and the wellbore 106. Faster the decay rates indicate more contact between the drill sting 104 and the wellbore 106. Such detection method may allow early detection of differential sticking (as shown in FIGS. 13 and 14) as well as the presence of a cutting bed (as shown in FIG. 12). It can also confirm wellbore issues, such as those shown in FIG. 11.

With such logging method involving multiple axial positions, the axial position of problem occurring in the annulus between the drill-sting 104 and the wellbore 106 can be determined. This may help the driller to take the proper actions for limiting the effect of the problem onto the drilling process.

Figure 14A:
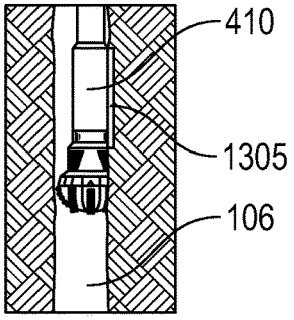
FIG. 14A illustrates a conceptual, side, schematic views of the BHA experiencing differential sticking in the wellbore.
Figure 14B:
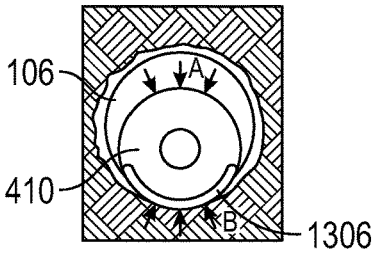
FIGS. 14B and 14C illustrate end views of the BHA experiencing differential sticking in the wellbore, according to an embodiment.
Figure 14C:
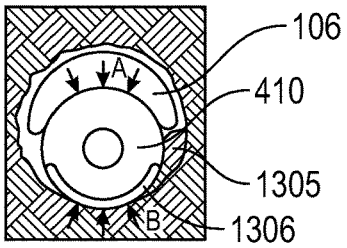

FIG. 14A illustrates a conceptual, side, schematic views of the BHA 410 experiencing differential sticking in the wellbore 106, and FIG. 14B, C illustrate end views of the BHA 410 experiencing differential sticking in the wellbore 106, according to an embodiment. When drilling, a filter cake may be built by the mud against the wall of the wellbore 106. This filter cake may be thin. However, it should isolate adequately the formation from the fluid in the wellbore 106. In some situations, the filter cake may be damaged by the rotation of the drill sting 104 and BHA 410. The filter cake can also build a thick ridge 1305 (see FIGS. 14A and 14C). In such case, the portion 1306 of the drill string 104 or BHA 410 may be submitted to a differential pressure effect. The pressure in the wellbore 106 ("A" side) is commonly higher than the pressure in the formation ("B" side) during overbalance drilling. This difference of pressure integrated over the contact defined by the portion 1306 over the axial extent of the differential sticking region creates a radial force which pushes the drill sting 104 or BHA 410 against the wellbore 106. This radial force drastically increases the friction along the wellbore 106 with the risk of locking the drill sting 104 against rotation or axial movement. The acoustic logging process described above (in relation with FIG. 13) may allow the detection of differential sticking (with the length of the problem). Such detection may provide the driller with an early warning of the occurrence of the problem as well as the location of the problem.

Figure 15A:
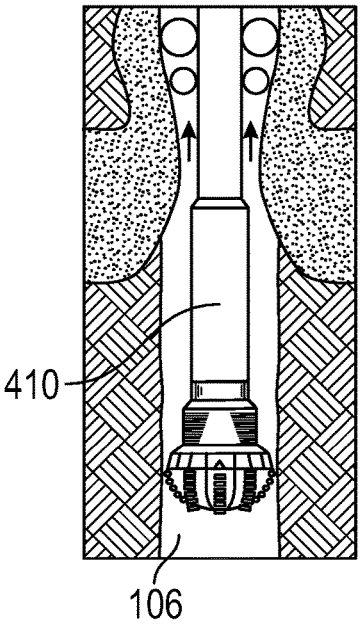
FIG. 15A illustrates a conceptual, side, schematic view the BHA in a reactive formation.
Figure 15B:
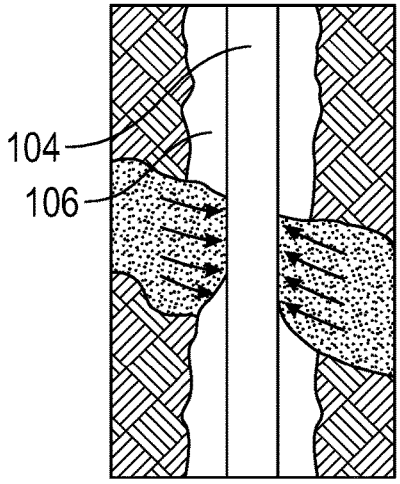
FIG. 15B illustrates a conceptual, side, schematic view of the drill string experiencing plastic deformation in the wellbore, according to an embodiment.
Figure 16:
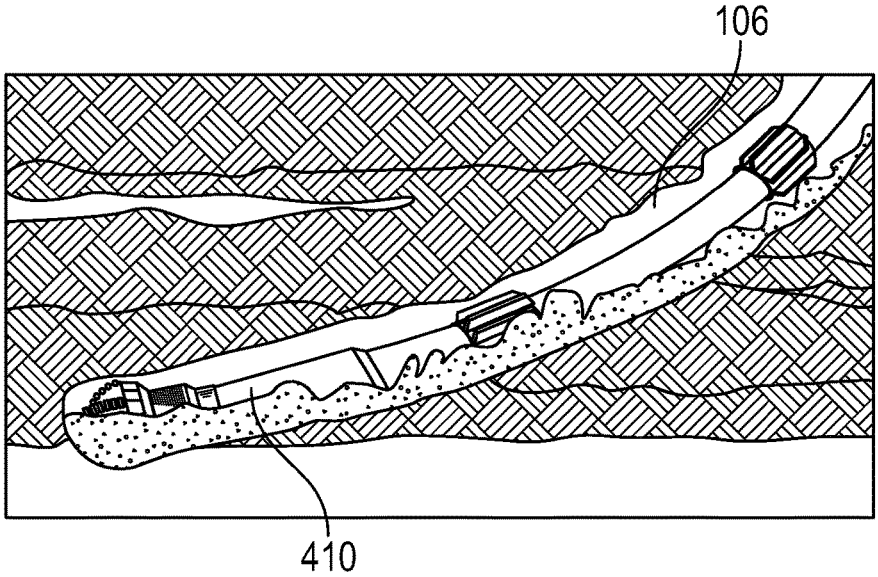
FIG. 16 illustrates a conceptual, side, schematic view of the drill string and BHA in a cutting bed, according to an embodiment.

FIG. 15A illustrates a conceptual, side, schematic view the BHA 410 in a reactive formation, and FIG. 15B illustrates a conceptual, side, schematic view of the drill string 104 experiencing plastic deformation in the wellbore 106, according to an embodiment. FIG. 16 illustrates a conceptual, side, schematic view of the drill string 104 and BHA 410 in a cutting bed, according to an embodiment. The usage of the acoustic logging method (as described in FIG. 13) by the downhole instrument 126 along the drill sting 104 may allow a user to determine the zones of contact between the drill string 104 and the wellbore 106. With such detection, the drilling process may be improved by early detection of the occurrence of these situations, allowing early remedies of these situations.

The downhole instrument 126 may use an acoustic transmitter. In one example, the transmitter may be able to generate broad-band impulses that are centralized at a frequency between about 5 kHz to about 20 kHz. A hydrophone array may be coupled to and/or positioned within the downhole instrument 126 or positioned at the surface. The downhole instrument 126 may measure and determine ringing decay. This may include coupling an indicator to the outer surface of the drill string 104. Sonic logging may help the downhole instrument 126 detect large contact with the subterranean formation 404. Such contact may include differential sticking, wellbore swelling, a high friction cutting bed, and the like.

Figure 17:
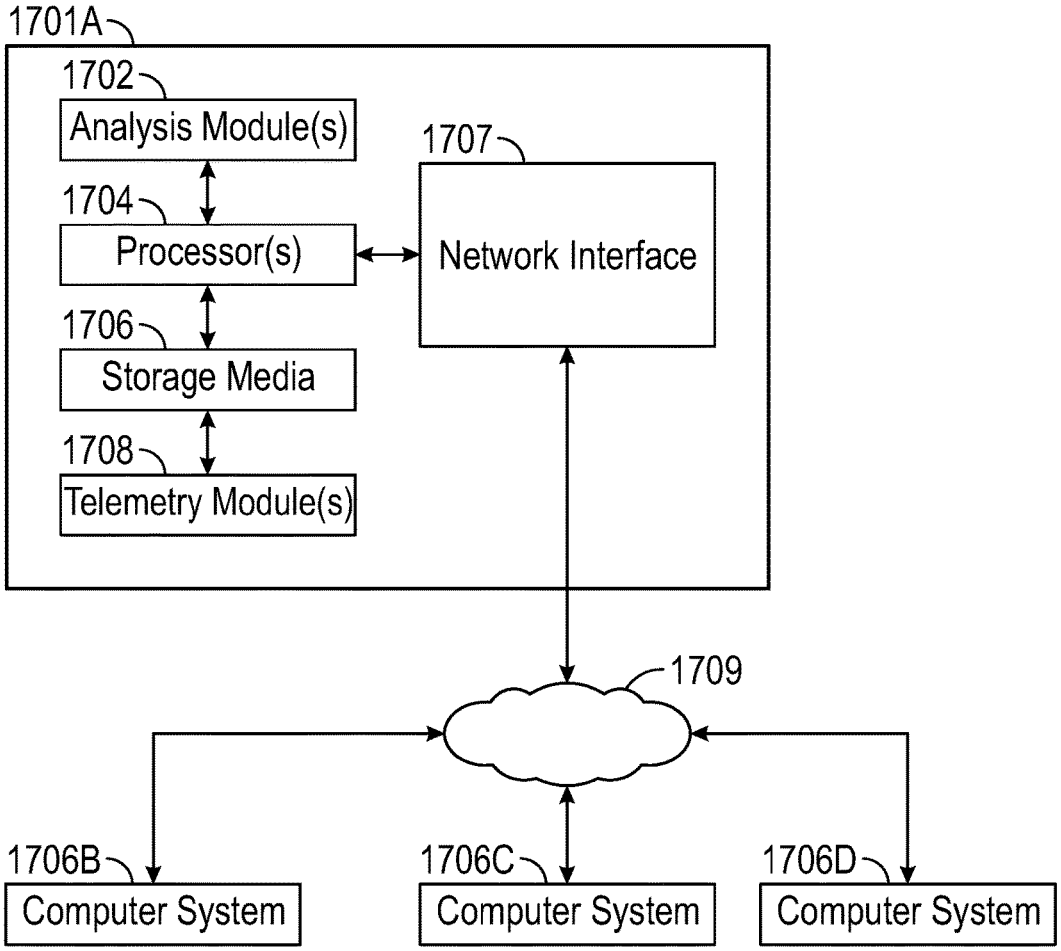
FIG. 17 illustrates a schematic view of a computing system, according to an embodiment.

In some embodiments, the methods of the present disclosure may be executed by a computing system. FIG. 17 illustrates an example of such a computing system 1700, in accordance with some embodiments. The computing system 1700 may include a computer or computer system 1701A, which may be an individual computer system 1701A or an arrangement of distributed computer systems. The computer system 1701A includes one or more analysis modules 1702 that are configured to perform various tasks according to some embodiments, such as one or more methods disclosed herein. To perform these various tasks, the analysis module 1702 executes independently, or in coordination with, one or more processors 1704, which is (or are) connected to one or more storage media 1706. The processor(s) 1704 is (or are) also connected to a network interface 1707 to allow the computer system 1701A to communicate over a data network 1709 with one or more additional computer systems and/or computing systems, such as 1701B, 1701C, and/or 1701D (note that computer systems 1701B, 1701C and/or 1701D may or may not share the same architecture as computer system 1701A, and may be located in different physical locations, e.g., computer systems 1701A and 1701B may be located in a processing facility, while in communication with one or more computer systems such as 1701C and/or 1701D that are located in one or more data centers, and/or located in varying countries on different continents).

A processor may include a microprocessor, microcontroller, processor module or subsystem, programmable integrated circuit, programmable gate array, or another control or computing device.

The storage media 1706 may be implemented as one or more computer-readable or machine-readable storage media. Note that while in the example embodiment of FIG. 17 storage media 1706 is depicted as within computer system 1701A, in some embodiments, storage media 1706 may be distributed within and/or across multiple internal and/or external enclosures of computing system 1701A and/or additional computing systems. Storage media 1706 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 1700 contains one or more telemetry module(s) 1708. The telemetry module(s) 1708 may be used to perform at least a portion of one or more embodiments of the methods disclosed herein (e.g., method 800).

It should be appreciated that computing system 1700 is only one example of a computing system, and that computing system 1700 may have more or fewer components than shown, may combine additional components not depicted in the example embodiment of FIG. 17, and/or computing system 1700 may have a different configuration or arrangement of the components depicted in FIG. 17. The various components shown in FIG. 17 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated. Additional information supporting the disclosure is contained in the appendix attached hereto.

What is claimed is:

1. A method for transmitting data from a downhole instrument to a surface location, comprising:

running the downhole instrument into a wellbore on a line, wherein the downhole instrument and at least a portion of the line are positioned inside a drill string, and wherein the downhole instrument comprises:

a first set of fingers configured to contact an inner surface of the drill string; and a second set fingers configured to contact the inner surface of the drill string; and measuring an effect occurring in the drill string using the downhole instrument, wherein the effect is due to perturbations in the drill string during a drilling process.

2. The method of claim 1, wherein the effect comprises a voltage differential between the first and second sets of fingers.

3. The method of claim 1, further comprising:

actuating the first and second sets of fingers radially-outward to contact the inner surface of the drill string; and actuating the first and second sets of fingers radially-inward after the effect is measured.

4. The method of claim 3, further comprising moving the downhole instrument to a different position within the drill string after the first and second sets of fingers are actuated radially-inward.

5. The method of claim 1, wherein the first and second sets of fingers comprise first and second electrodes, respectively, that are insulated from a body of the downhole instrument, and wherein the first and second electrodes are configured to measure a current in the drill string.

6. The method of claim 5, wherein the first and second electrodes are also configured to measure when the current has been injected by a dipole in the drill string or by a source at the surface location into a subterranean formation surrounding the drill string.

7. The method of claim 5, further comprising transmitting telemetry data from the downhole instrument to the surface location using a dipole installed in the drill string, wherein the telemetry data comprises the measured current.

8. The method of claim 1, wherein the first and second sets of fingers contact the inner surface of the drill string at two axially-offset locations separated by a known distance.

9. The method of claim 1, wherein the downhole instrument is submitted to the same mechanical deformation as the drill string when a load on the drill string varies, wherein the downhole instrument is configured to measure the mechanical deformation, and wherein the downhole instrument transmits the measured mechanical deformation to a computing system at the surface location.

10. The method of claim 9, wherein the measured mechanical deformation is correlated to a measurement of a load applied on the drill string, wherein the load applied on the drill string comprises torque, an axial load, or a combination thereof.

11. The method of claim 10, further comprising determining friction along the drill string using the correlation, wherein the friction occurs during drilling, reaming, or trip conditions.

12. The method of claim 1, wherein the downhole instrument comprises one or more accelerometers that are configured to measure shock, vibration, whirling, or a combination thereof of the drill string in a radial direction, an axial direction, or both.

13. The method of claim 12, further comprising determining a drilling behavior of the drill string at different depths based upon the measured shock, vibration, and whirling.

14. The method of claim 1, further comprising performing acoustic logging inside the drill string using the downhole instrument, wherein the acoustic logging comprises:

centralizing the downhole instrument in the drill string;

sending a broadband acoustic signal from an acoustic transmitter in the downhole instrument;

receiving a reflected acoustic signal using an acoustic sensor in the downhole instrument;

determining a rate of decay of the reflected acoustic signal; and determining, based upon the rate of decay, a degree of coupling between the drill string and the subterranean formation or between the drill string and an accumulation inside the wellbore.

15. The method of claim 14, further comprising:

determining the degree of coupling at different positions of the downhole instrument in the drill string; and determining zones where the degree of coupling is greater than a predetermined amount, or where a variation of the degree of coupling versus depth is greater than a predetermined amount.

16. A drilling system, comprising;

a bottom-hole assembly configured to measure a property and to generate an electrical current to communicate digital information comprising the measured property;

a drill string coupled to the bottom-hole assembly;

a line positioned within the drill string; and a downhole instrument positioned within the drill string and coupled to the line, wherein the downhole instrument comprises:

a first electrode configured to expand radially-outward into contact with a first point on an inner surface of the drill string; and a second electrode configured to expand radially-outward into contact with a second point on the inner surface of the drill string, wherein the downhole instrument is configured to measure a voltage differential between the first and second points on the drill string, and wherein the voltage differential is caused by the electrical current flowing through the drill string as a result of the electrical current generated by the bottom-hole assembly.

17. The system of claim 16, wherein the downhole instrument comprises:

an anchor configured to secure the downhole instrument in place within the drill string;

a first opening block that is at least partially axially-aligned with, and radially-inward from, the first electrode; and a second opening block that is at least partially axially-aligned with, and radially-inward from, the second electrode.

18. The system of claim 17, wherein the downhole instrument further comprises a biasing member positioned adjacent to the first opening block, wherein the biasing member exerts an axial force on the first opening block in a first axial direction.

19. A method for transmitting data from a downhole instrument to a surface location, comprising:

running the downhole instrument into a wellbore on a line, wherein the downhole instrument and at least a portion of the line are positioned inside a drill string;

measuring a property using the downhole instrument, wherein the downhole instrument is coupled to the drill string;

generating an electrical current that flows into a subterranean formation, wherein the electrical current comprises a signal representing the measured property; and measuring a voltage differential between first and second points on the drill string using the downhole instrument, wherein the voltage differential is caused by the electrical current flowing through the drill string.

20. The method of claim 19, further comprising actuating the downhole instrument from an unset mode into a set mode, wherein, in the set mode:

an anchor expands radially-outward and into contact with the drill string to secure the downhole instrument in place;

a first electrode expands radially-outward and into contact with the first point on the drill string; and a second electrode expands radially-outward and into contact with the second point on the drill string, and wherein the first and second electrodes measure the voltage differential.

21. The method of claim 20, further comprising:

transmitting the measured voltage differential through the line to a computing system at a surface location; and recovering the measured property from the measured voltage differential using the computing system.

22. The method of claim 21, further comprising:

actuating the downhole instrument from the set mode into the unset mode after the measured voltage differential is transmitted to the computing system; and pulling the line and the downhole instrument back to the surface location after the downhole instrument is actuated into the unset mode.

23. The method of claim 21, further comprising performing a drilling action in response to recovering the measured property.

* * * * *